US005755581A

United States Patent [19]

Suzuki

[11] Patent Number: 5,755,581

[45] Date of Patent: May 26, 1998

[54] PLUG CAP FOR SPARK PLUG

[75] Inventor: Takahiko Suzuki, Shizuoka, Japan

[73] Assignee: Yazaki Corporation, Tokyo, Japan

[21] Appl. No.: 636,493

[22] Filed: Apr. 23, 1996

[30] Foreign Application Priority Data

Jun. 15, 1995 [JP] Japan ..... 7-149001

[51] Int. Cl.[6] ..... H01R 13/44

[52] U.S. Cl. ..... 439/125; 439/271

[58] Field of Search ..... 439/125, 271, 439/126–128

[56] References Cited

U.S. PATENT DOCUMENTS 5,324,207 6/1994 Itoh et al. ..... 439/125

FOREIGN PATENT DOCUMENTS 61-61779 4/1986 Japan .
61-151268 9/1986 Japan .
61-166390 10/1986 Japan .
63-35268 3/1988 Japan .
4-81490 7/1992 Japan .

*Primary Examiner*—Khiem Nguyen
*Assistant Examiner*—Eugene G. Byrd
*Attorney, Agent, or Firm*—Morgan, Lewis & Bockius LLP

[57] ABSTRACT

A plug cap for a spark plug having a proximal end portion of an insulating resin pipe that has a double wall construction which has an outer wall fitted in a rain cover portion fitted on the insulating resin pipe, and an inner wall fitted on a high-voltage wire. The portion of an annular space (which is formed by the double wall construction, and has a closed bottom) close to the bottom thereof, is divided by a pair of ribs into two or more sections. A ventilation air hole, communicating with a plug hole, is open to one of the sections of the annular space, and a through hole, formed in the rain cover portion, is disposed in an overlying relation to the section of the annular space other than the section to which the air hole is open.

19 Claims, 4 Drawing Sheets

PLUG CAP FOR SPARK PLUG

BACKGROUND OF THE INVENTION

1. Field of the Invention

This invention relates to a plug cap for a spark plug wherein the cap has such a construction that water is prevented from intruding into a plug hole, in which the plug cap is mounted, through a vent hole formed in the plug cap.

2. Background

FIGS. 5 and 6 show the construction of a conventional plug cap.

This plug cap 41 includes a cylindrical insulating resin pipe 43 of a rigid insulating resin through which a high-voltage wire 42 with a terminal, connected to a spark plug 53, is passed, a rubber cap 44 mounted on a distal end of the insulating resin pipe 43 to closely fit on the spark plug 53, and a rain cover portion 45 of rubber which is mounted on a proximal end of the insulating resin pipe 43 to close a plug hole 3, formed in an engine head 50, in a watertight manner, and guides the high-voltage wire 42 in a lateral direction.

An opening 50*a*, which is formed in the engine head 50, and communicates with the plug hole 3, has an inner peripheral surface larger in diameter than an inner peripheral surface 3*a* of the plug hole 3, and an upwardly-directed, annular flange 52 is formed on a seat portion 51 of the opening 50*a*.

The rain cover portion 45 has a seal portion 47 which closely fits in an inner surface 3*b* slightly larger in diameter than the inner peripheral surface 3*a* of the plug hole 3, and a cap-like flange 46 fitted on the annular flange 52. The flange 46 has a skirt portion 49 engaged in a peripheral groove 54 formed around the annular flange 52. A through hole 48 for ventilation purposes is formed in the rain cover portion 45, and extends in an upward-downward direction. This through hole 48 communicates with the atmosphere and with the plug hole 3, and serves to remove the air during a plug cap-mounting operation and also to effectuate ventilation during the heating and cooling in the plug hole 3.

However, the above conventional construction has a problem that when water splashes the rain cover portion 45, for example, during the washing of a car, the water is liable to intrude into the plug hole 3 through the through hole 48, as shown in FIG. 6. When the water thus intrudes, leakage current develops, so that non-ignition is encountered, and also the voltage-resistance properties of the insulating resin pipe 43 are adversely affected.

SUMMARY OF THE INVENTION

The present invention has been made in view of the above problems, and an object of the invention is to provide a plug cap for a spark plug which prevents water from intruding into a plug hole through a hole formed in the plug cap without affecting air-removing and a ventilation, thereby enhancing waterproofing abilities, thus ensuring stable ignition.

To achieve the above object, the present invention provides a plug cap for a spark plug including an insulating resin pipe of a cylindrical shape which has a flange for closely fitting in a plug hole, and passes a high-voltage wire with a terminal therethrough. A rain cover portion is fitted onto a proximal end portion of the insulating resin pipe, the rain cover portion having a through hole for ventilation purposes. The proximal end portion of the insulating resin pipe has a double wall construction, which has an annular outer wall snugly fitted in the rain cover portion, and an annular inner wall snugly fitted on the high-voltage wire in coaxial relation to the outer wall. At least a pair of ribs are formed upright in an annular space with a closed bottom which is formed between the two walls, the ribs dividing that portion of the annular space close to the bottom thereof into a plurality of sections. An air hole, communicating the annular space with that portion of the plug hole disposed below the flange, is open to the bottom of the annular space. The through hole is disposed in overlying relation to that section of the annular space other than the section to which the air hole is open.

Preferably, the outer wall is smaller in length than the inner wall, and the rain cover portion has an annular step portion against which an upper end of the outer wall is abutted, and the annular step portion limits the depth of insertion of the insulating resin pipe.

That portion of the annular space (which is formed by the double wall construction of the proximal end portion of the insulating resin pipe) close to the bottom thereof is divided into the plurality of sections. The through hole formed in the rain cover portion, and the air hole formed in the insulating resin pipe, are open to the different sections of the annular space, respectively. Therefore, even if water intrudes into one section of the annular space through the through hole, the water will not flow into the other section to which the air hole is open. Therefore, the intrusion of the water into the plug hole is prevented. And besides, with respect to water flowed along the outer surface of the rain cover portion to be collected in an open portion in an engine head, the outer wall and the inner wall, respectively, contact the rain cover portion and the high-voltage wire with a uniform contact force. Therefore, even if a water-drawing effect is produced, for example, by the decrease of the pressure within the plug hole, the intrusion of the water is prevented.

DETAILED DESCRIPTION OF THE PREFERRED EMBODIMENTS

Figure 1:
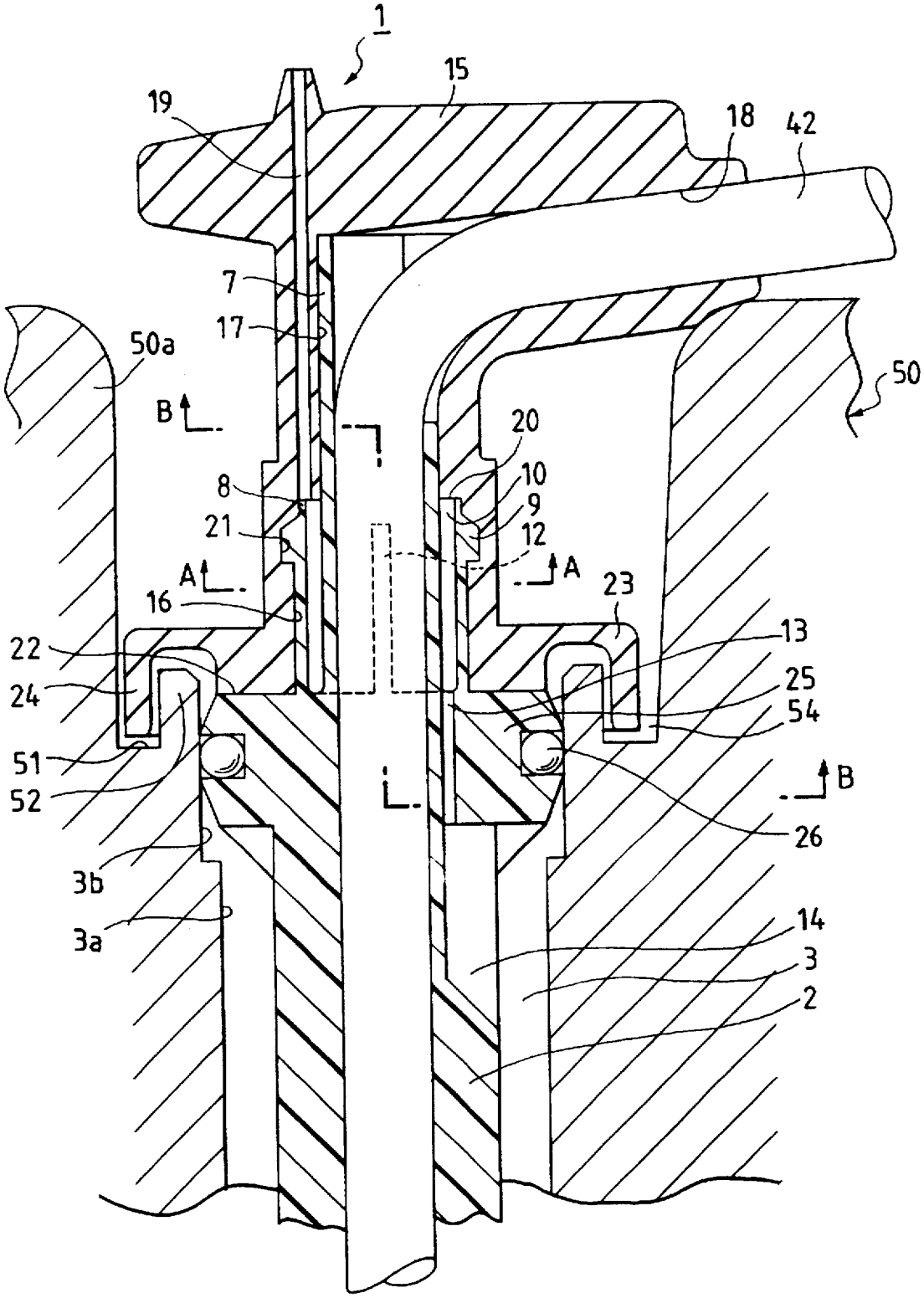
FIG. 1 is a vertical cross-sectional view of a preferred embodiment of a spark plug cap of the invention.

A preferred embodiment of a spark plug cap of the invention will now be described in detail with reference to the drawings. Those portions identical to those of the conventional construction will be designated by identical reference numerals, respectively, and explanation thereof will be omitted.

Figure 2:
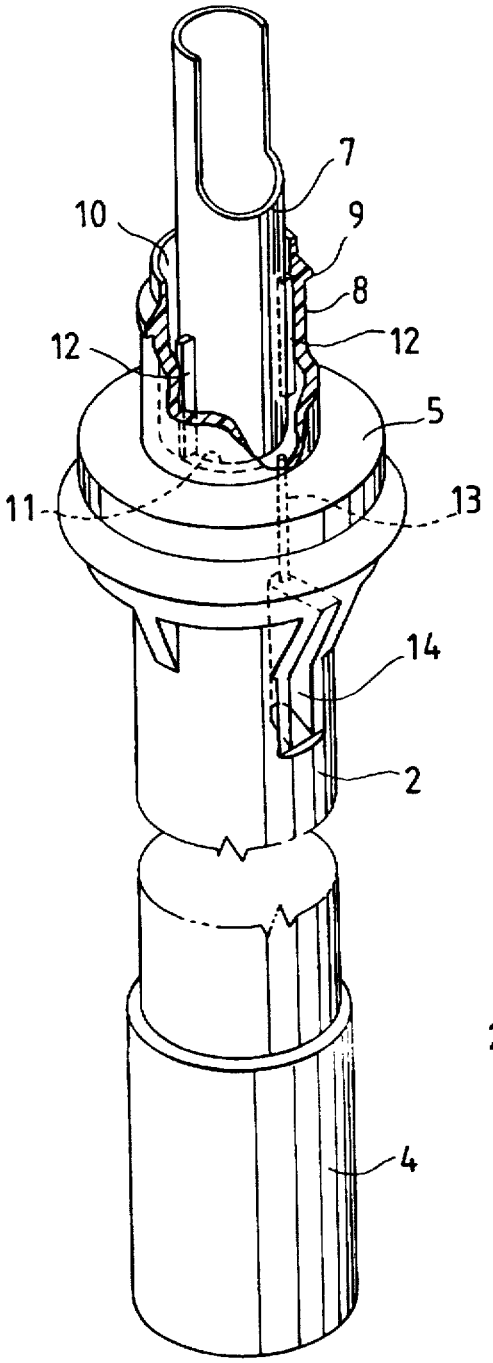
FIG. 2 is a partial perspective view showing an insulating pipe of the plug cap of FIG. 1.
Figure 3:
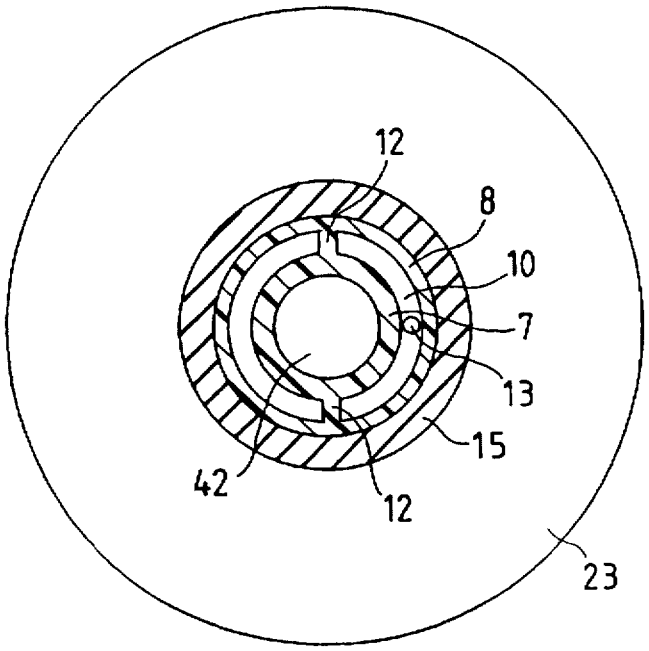
FIG. 3 is a cross-sectional view taken along the line A—A of FIG. 1.
Figure 4:
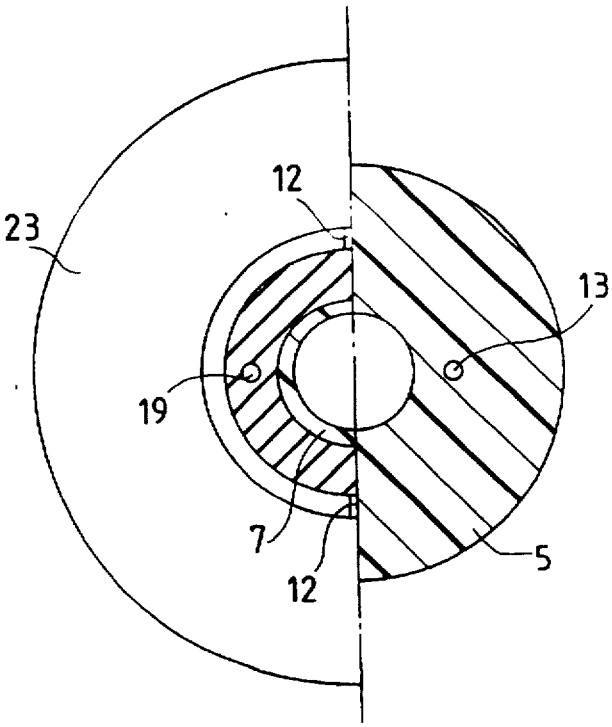
FIG. 4 is a cross-sectional view taken along the line B—B of FIG. 1.

FIG. 1 is enlarged, cross-sectional view of an the spark plug cap of the invention in its mounted condition; FIG. 2 is a partial perspective view showing an insulating resin pipe of the spark plug cap of the invention; FIG. 3 is a cross-sectional view taken along the line A—A of FIG. 1; and FIG. 4 is a cross-sectional view taken along the line B—B of FIG. 1.

As shown in FIG. 2, the insulating resin pipe 2 (hereinafter referred to as "insulating pipe") is made of a synthetic resin., and is formed into a hollow, cylindrical configuration so that a high-voltage wire with a terminal can pass through. An annular flange 5 is formed integrally at a proximal end portion of the insulating pipe 2.

Figure 5:
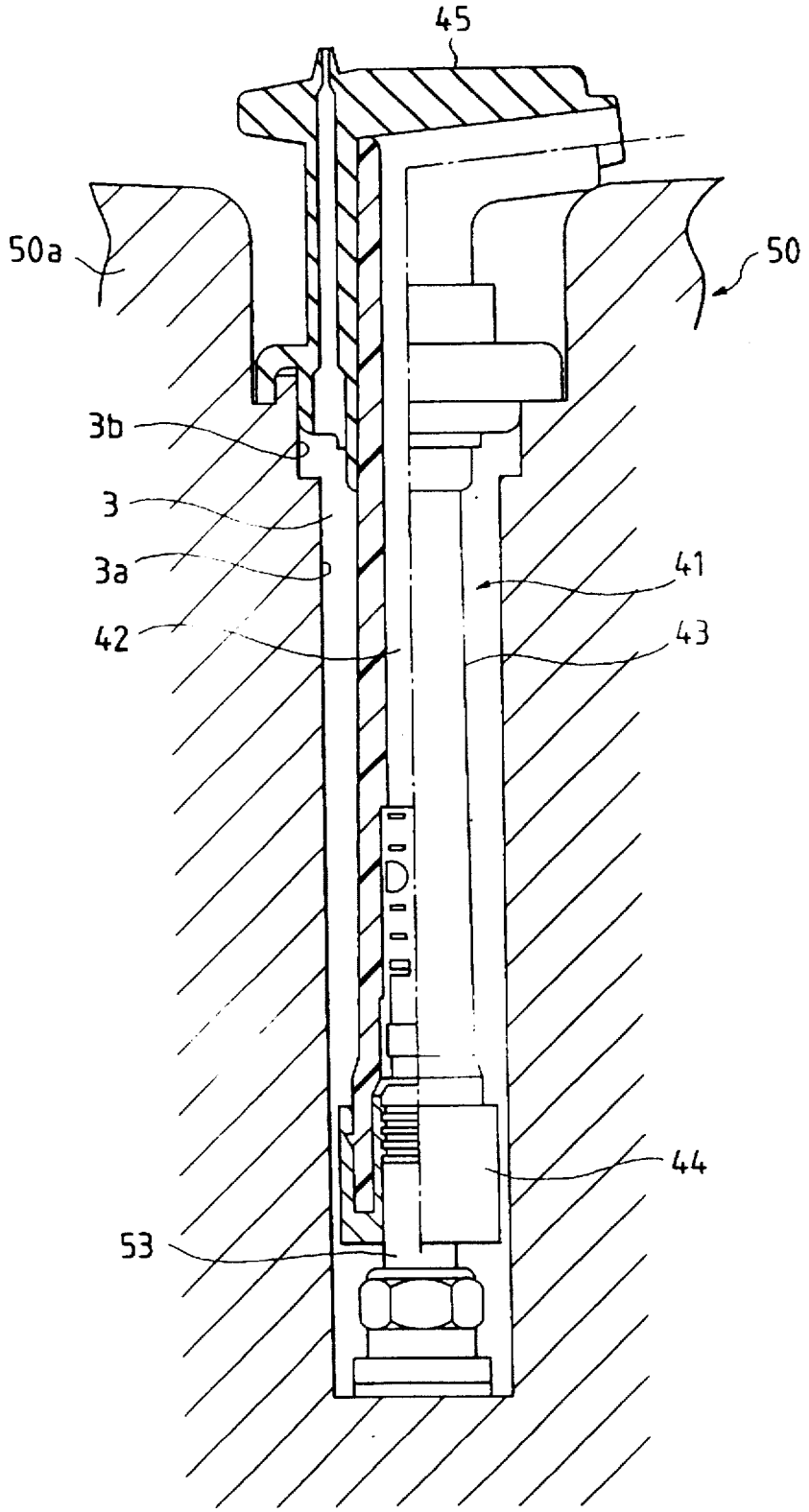
FIG. 5 PRIOR ART
FIG. 5 is a vertical cross-sectional view of a conventional plug cap for a spark plug.
Figure 6:
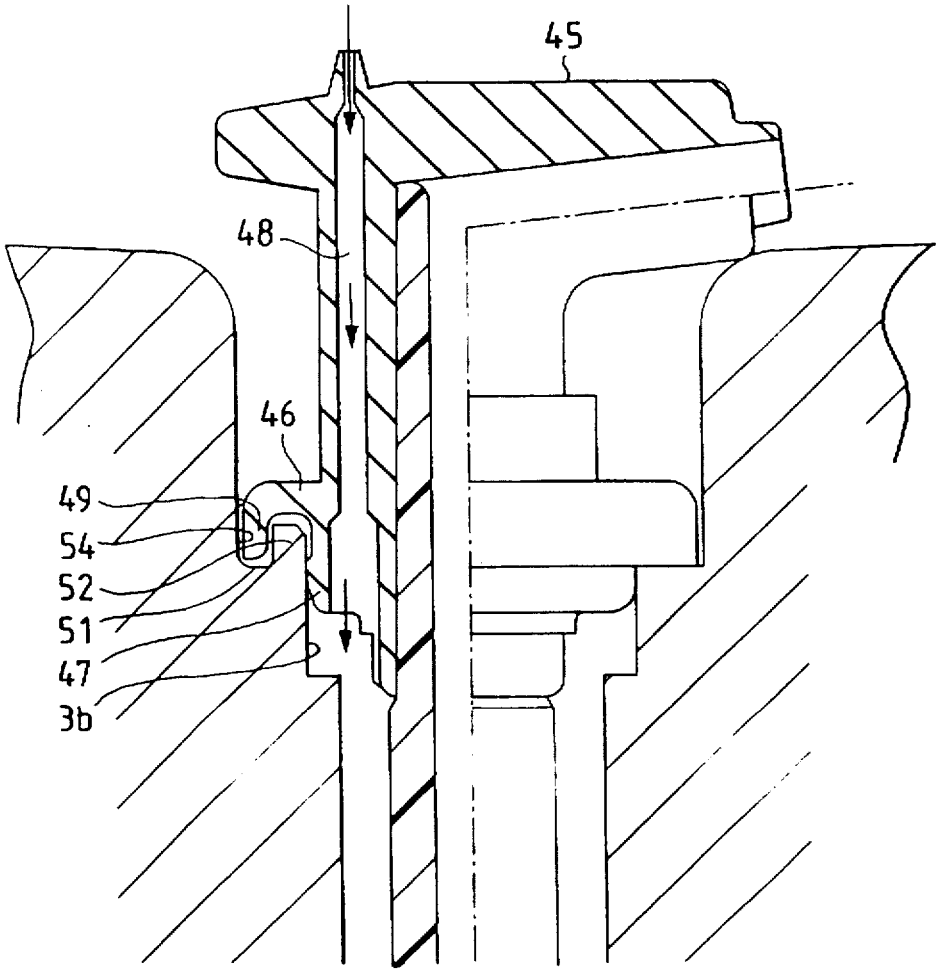
FIG. 6 PRIOR ART
FIG. 6 is a vertical cross-sectional view of an important portion of the plug cap of FIG. 5.

As in the conventional construction of FIG. 5, a cap 4 of rubber for closely fitting a spark plug is fitted a distal end portion of the insulating pipe 2, and a rain cover portion 15 (described later) is fitted on the proximal end portion of the insulating pipe 2.

The proximal end portion of the insulating pipe 2 extends from an upper surface of the flange 5, and has a double wall construction which has an annular inner wall 7 snugly fitted on the high-voltage wire 42 passing through the bore of the insulating pipe 2, and an annular outer wall 8 snugly fitted in the rain cover portion 15, the outer wall 8 being coaxial with the inner wall 7.

The outer wall 8 is smaller in axial length or height than the inner wall 7, and has on its outer peripheral surface an annular engagement projection 9 which engages the rain cover portion 15. An upper end portion of the inner wall 7 has a semi-circular cross-section to provide an opening through which the high-voltage wire 42 is led out in a lateral direction.

An annular space 10 with a closed bottom is formed between the outer wall 8 and the inner wall 7, and a pair of ribs 12 extends upwardly from a bottom surface 11 of this annular space, and interconnects the outer wall 8 and the inner wall 7. The bottom surface 11 is defined by part of the upper surface of the flange 5.

The ribs 12 are smaller in length than the inner wall 7 and the outer wall 8, and are disposed in opposed relation to each other within the annular space 10, and divide a lower portion (close to the bottom surface 11) of the annular space 10 into a plurality of (two in this embodiment) sections. Because of the provision of the ribs 12, water, collected in one of the sections, will not flow into the other section.

As is clear from FIG. 3, an air hole 13 is formed in the bottom surface 11 in one of the sections of the annular space 10, and this air hole 13 extends through the flange 5, and communicates with a notch groove 14 which is open to the outer peripheral surface of the insulating pipe 2 beneath the flange 5.

A ring groove 25 is formed in the annular flange 5, and a seal ring 26 is engaged or received in the ring groove 25. When the plug cap 1 is mounted in a plug hole 3, the seal ring 26 is pressed against the inner surface of the plug hole 3.

As shown in FIG. 1, the rain cover portion 15, made of a rubber, has an insertion hole 16 of a larger diameter for fitting on the insulating pipe 2, and another insertion hole 17 of a smaller diameter extending from the insertion hole 16, the two insertion holes 16 and 17 being formed axially in the rain cover portion 15. The smaller-diameter insertion hole 17 communicates at its side with a wire lead-out hole 18.

A through hole 19 for ventilation purposes extends vertically through that portion of the rain cover portion 15 where the two insertion holes 16 and 17 are not provided. The through hole 19 is open to an annular step portion 20 defining the boundary between the two insertion holes 16 and 17. When the rain cover portion 15 is fitted onto the insulating pipe 2, the through hole 19 is disposed in an overlying relation to the section of the annular space 10 other than the section to which the air hole 13 is open, as shown in FIG. 4. When the insulating pipe 2 is inserted into the rain cover portion 15, the upper end of the outer wall 8 abuts against the annular step portion 20, and thus the annular step portion 20 limits the depth of insertion of the insulating pipe 2.

An annular retaining groove 21, corresponding to the engagement projection 9 of the insulating pipe 2, is formed in the inner surface of the larger-diameter insertion hole 16. The rain cover portion 15 has a lower end 22 for abutting against the upper surface of the flange 5 of the insulating pipe 2. A cap-like flange 23 extends radially outward from the lower end 22, and a skirt portion 24 extends from this flange 23.

The flange 23 and skirt portion 24 of the rain cover portion 15 engage an annular flange 52 formed on a seat portion 51 in an open portion 50*a* of an engine head 50.

The assembling of the spark plug cap 1 of this embodiment having the above construction will now be described.

In the plug cap 1 for the spark plug, the high-voltage wire connection terminal (see FIG. 5), fixedly secured to the distal end of the high-voltage cable 42, is first passed through the rain cover portion 15, and is further inserted into the insulating pipe 2 through the proximal end thereof, and then is fixedly secured to the distal end of the insulating pipe 2. At the same time, the rain cover portion 15 is fitted on the insulating pipe 2 in such a manner that the proximal end portion of the insulating pipe 2 is inserted into the insertion holes 16 and 17 in the rain cover portion 15. At this time, the insulating pipe 2 is inserted until the upper end of the outer wall 8 is brought into abutment against the annular step portion 20.

When the rain cover portion 15 is thus fitted on the insulating pipe 2, the through hole 19 open to the annular step portion 20 is disposed in overlying relation to the section of the annular space 10 other than the section to which the air hole 13 in the insulating pipe 2 is open, as shown in FIGS. 3 and 4, and the engagement projection 9 is engaged in the retaining groove 21.

The spark plug cap 1 thus assembled is inserted or mounted in the plug hole 2 in the engine head 50. The cap-like flange 23 of the rain cover portion 15 fits on the annular flange 52, and the seal ring 26 is held in intimate contact with the inner surface 3*b* of the plug hole 3 immediately below the annular flange 52.

The lower end 22 of the rain cover portion 15 is held in intimate contact with the upper surface of the flange 5 of the insulating pipe 2, and the upper end of the outer wall 8 is abutted against the annular step portion 20. As a result, even if water intrudes from the exterior through the through hole 19 in the rain cover portion 15, the water is collected in one section of the annular space 10, but will not flow into the other section over the ribs 12. Therefore, the water will not intrude into the plug hole 3 through the air hole 13. On the other hand, the air in the plug hole 3 is guided to the annular space 10 through the notch groove 14, formed in the insulating pipe 2, and the air hole 13, and is further fed through those portions of the annular space 10 except the ribs 12, and is discharged to the exterior through the through hole 19.

In the above embodiment, although the annular space is divided by the ribs interconnecting the outer wall and the inner wall, the annular space may be divided by a cylindrical wall (rib) coaxial with the outer and inner walls, in which case an air hole is open to an annular space formed, for example, between the cylindrical wall and the inner wall, and the rain cover portion is fitted on the insulating pipe in such a manner that the through hole is disposed in overlying relation to an annular space formed between the cylindrical wall and the outer wall.

In the plug cap of the invention for the spark plug, even if water, splashing the plug cap 1, intrudes through the through hole 19, for example, during the washing of a car, the water, collected on the bottom portion of the annular space, will not flow over the ribs, and therefore will not flow into the air hole 13, since the lower portion of the annular space (which communicates with the air hole) close to the bottom surface is divided by the ribs. On the other hand, since the air hole communicates with the through hole at the upper portion of the annular space, the ventilation can be effected satisfactorily as in the conventional construction.

The proximal end portion of the insulating pipe has the double wall construction, and is held in slightly-elastic contact with the inner peripheral surface of the rain cover portion and the outer peripheral surface of the high-voltage wire, and therefore water, collected in a gap between the outer surface of the rain cover portion and the inner surface of the plug hole, is prevented from intrusion. Particularly, the inner surfaces of insertion holes in the rain cover portion respectively contact the outer and inner walls of the insulating pipe with a uniform contact force, and therefore a water-drawing effect due to the decrease of the pressure in the plug hole is prevented.

What is claimed is:

1. A plug cap for a spark plug to be connected to a high-voltage wire, comprising:

a pipe having a proximal end, a distal end, and a flange portion for closely fitting in a plug hole receiving the spark plug, the pipe adapted to receive therethrough the high-voltage wire;

a rain cover portion fitted on the proximal end of the pipe, the rain cover portion having a through hole for ventilation;

the pipe including a double wall portion including an annular outer wall fitted in the rain cover portion, and a coaxial annular inner wall adapted to fit on the high-voltage wire, the double wall portion being disposed at the proximal end of the pipe and including an annular space between the annular outer wall and the annular inner wall;

ribs formed in the annular space and extending between the annular outer wall and the annular inner wall, the ribs dividing a lower portion of the annular space into a plurality of sections; and an air hole communicating the annular space with that portion of the plug hole disposed below the flange portion, which is open to the bottom of the annular space, wherein the through hole is disposed in overlying relation to that section of the annular space other than the section to which the air hole is open.

2. The plug cap of claim 1, wherein the annular outer wall is smaller in length than the annular inner wall, and the rain cover portion has an annular step portion against which an upper end of the annular outer wall is abutted, and the annular step portion limits a depth of insertion of the pipe.

3. The plug cap of claim 1, wherein an annular engagement projection is formed on an outer peripheral surface of the outer wall, and an annular retaining groove is formed in an inner surface of the rain cover portion, and the engagement projection is engaged in the retaining groove, thereby fixing the rain cover portion to the pipe.

4. The plug cap of claim 1, wherein a ring groove is formed in the flange portion, and a seal ring, for pressing against the inner surface of the plug hole, is received in the ring groove.

5. The plug cap of claim 1, wherein the pipe is made of a synthetic resin.

6. The plug cap of claim 1, wherein the rain cover portion is made of a rubber.

7. The plug cap of claim 1, wherein at least a pair of ribs are formed upright in the annular space with the bottom which is formed between the annular outer wall and the annular inner wall.

8. The plug cap for a spark plug according to claim 2, wherein an annular engagement projection is formed on an outer peripheral surface of the outer wall, and an annular retaining groove is formed in an inner surface of the rain cover portion, and the engagement projection is engaged in the retaining groove, thereby fixing the rain cover portion to the pipe.

9. The plug cap for a spark plug according to claim 8, wherein a ring groove is formed in the flange portion, and a seal ring, for pressing against the inner surface of the plug hole, is received in the ring groove.

10. The plug cap for a spark plug according to claim 9, wherein the pipe is made of a synthetic resin.

11. The plug cap for a spark plug according to claim 9, wherein the rain cover portion is made of a rubber.

12. The plug cap for a spark plug according to claim 9 wherein at least a pair of ribs are formed upright in the annular space with the bottom which is formed between the annular outer wall and the annular inner wall.

13. The plug cap for a spark plug according to claim 8, wherein the pipe is made of a synthetic resin.

14. The plug cap for a spark plug according to claim 8, wherein the rain cover portion is made of a rubber.

15. The plug cap for a spark plug according to claim 8 wherein at least a pair of ribs is formed upright in a lower portion of the annular space and between the annular outer wall and the annular inner wall.

16. The plug cap for a spark plug according to claim 3, wherein a ring groove is formed in the flange portion, and a seal ring, for pressing against the inner surface of the plug hole, is received in the ring groove.

17. The plug cap for a spark plug according to claim 3, wherein the pipe is made of a synthetic resin.

18. The plug cap for a spark plug according to claim 3, wherein the rain cover portion is made of a rubber.

19. The plug cap for a spark plug according to claim 3 wherein at least a pair of ribs are formed upright in the annular space with the bottom which is formed between the annular outer wall and the annular inner wall.

* * * * *